United States Patent [19]

von Recklinghausen

[11] 4,383,134

[45] May 10, 1983

[54] LOUDSPEAKER SYSTEMS

[75] Inventor: Daniel R. von Recklinghausen, Arlington, Mass.

[73] Assignee: Electro Audio Dynamics, Inc., Great Neck, N.Y.

[21] Appl. No.: 128,829

[22] Filed: Mar. 10, 1980

[51] Int. Cl.[3] ..... H04R 3/12

[52] U.S. Cl. ..... 179/1 D

[58] Field of Search ..... 179/1 D, 1 E

[56] References Cited

U.S. PATENT DOCUMENTS

| | | | |
|---|---|---|---|
| 1,931,235 | 10/1933 | Nicolson | 179/1 D |
| 2,007,747 | 7/1935 | Ringel | 179/1 D |
| 3,061,676 | 10/1962 | Wirth | 179/1 D |
| 3,715,501 | 2/1973 | Russell | 179/1 D |
| 3,988,541 | 10/1976 | Boast | 179/1 D |
| 4,100,371 | 7/1978 | Bayliff | 179/1 D |
| 4,198,540 | 4/1980 | Cizek | 179/1 D |
| 4,237,340 | 12/1980 | Klipsch | 179/1 D |

*Primary Examiner*—Joseph A. Popek

*Attorney, Agent, or Firm*—Holland, Armstrong, Wilkie & Previto

[57] ABSTRACT

An improved loudspeaker system is disclosed which includes a passive electrical network between the speaker input and the output of a speaker driver for reproducing bass frequencies. The loudspeaker uses a closed box system and obtains an extended low frequency response through the use of critical relationships in the passive electrical network including high order transfer functions.

3 Claims, 14 Drawing Figures

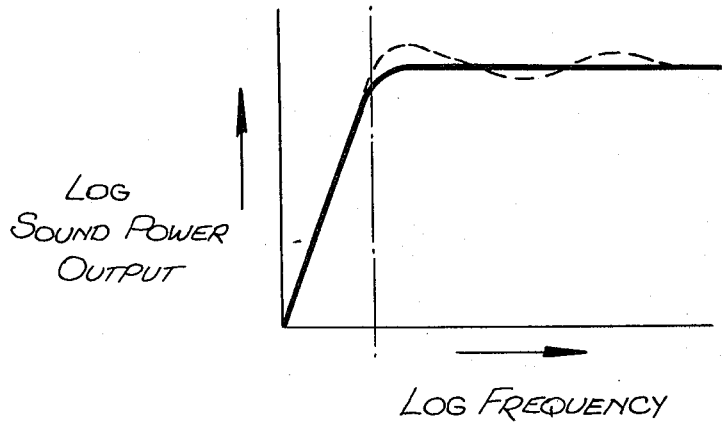
Fig. 8.
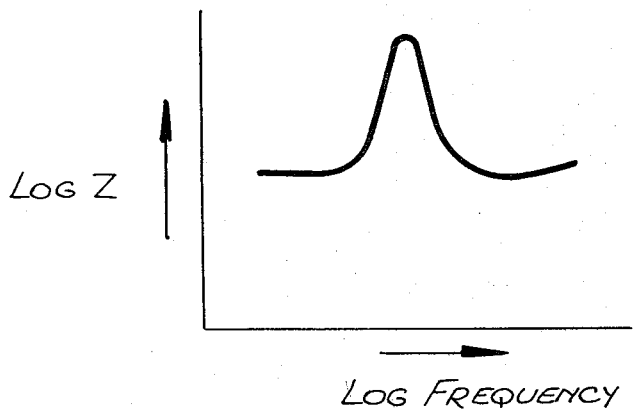
Fig. 9.
(PRIOR ART)
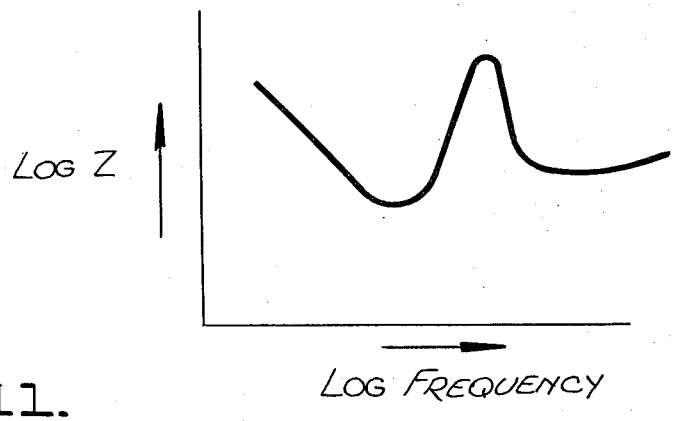
Fig. 10.
Fig. 11.
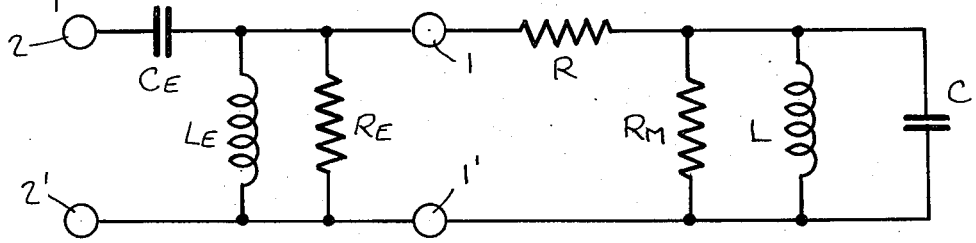

MAXIMALLY FLAT CLOSED BOX LOUDSPEAKERS

-3dB @ S=1 VOICE COIL RESISTANCE = 1

TABLE 1

| | FILTER | | | | | | | | | | | |
|---|---|---|---|---|---|---|---|---|---|---|---|---|
| | L | C | $S_C$ | $Q_C$ | $S_C$ | $C_E$ | $L_E$ | $S_E$ | $S_F$ | $Q_F$ | $Z_{MIN}$ | $S_{MIN}$ |
| 2ND | 1.414 | .707 | 1.000 | .707 | 1.414 | — | — | — | — | — | 1.000 | 0.00 |
| 3RD | 1.333 | .667 | 1.061 | .707 | 1.500 | 2.000 | — | — | — | — | 1.000 | .699 |
| 4TH a | .639 | .507 | 1.758 | .890 | 1.974 | 1.565 | 1.974 | .569 | — | — | .412 | .863 |
| 4TH b | 1.974 | 1.565 | .569 | .890 | .639 | .507 | .639 | 1.758 | — | — | | |
| c | .765 | 1.307 | 1.000 | 1.307 | .765 | — | — | — | 1.000 | .541 | 1.000 | 0.00 |
| d | 1.848 | .541 | 1.000 | .541 | 1.848 | — | — | — | 1.000 | 1.307 | 1.000 | 0.00 |
| 5TH a | .618 | .618 | 1.618 | 1.000 | 1.618 | 1.618 | 1.618 | .618 | 1.000 | — | .347 | .911 |
| 5TH b | 1.618 | 1.618 | .618 | 1.000 | .618 | .618 | .618 | 1.618 | 1.000 | — | | |
| a | .854 | .447 | 1.618 | .724 | 2.236 | 2.618 | — | — | 1.000 | 1.618 | 1.000 | .939 |
| b | .618 | 1.000 | 1.272 | 1.272 | 1.000 | 1.618 | — | — | 1.000 | .618 | 1.000 | .931 |
| 6TH a | .607 | .365 | 2.124 | .775 | 2.739 | 1.647 | 2.739 | .471 | 1.000 | 1.932 | .562 | .878 |
| 6TH b | 2.739 | 1.647 | .471 | .775 | .607 | .365 | .607 | 2.124 | 1.000 | 1.932 | | |
| 6TH c | .733 | .521 | 1.618 | .843 | 1.919 | 1.365 | 1.919 | .618 | 1.000 | .707 | .357 | .936 |
| 6TH d | 1.919 | 1.365 | .618 | .843 | .733 | .521 | .733 | 1.618 | 1.000 | .707 | | |
| 6TH e | .586 | .743 | 1.515 | 1.126 | 1.346 | 1.706 | 1.346 | .660 | 1.000 | .518 | .284 | .916 |
| 6TH f | 1.346 | 1.706 | .660 | 1.126 | .586 | .743 | .586 | 1.515 | 1.000 | .518 | | |

LOUDSPEAKER SYSTEMS

BACKGROUND OF THE INVENTION

The present invention relates to improvements in loudspeaker systems designed to reproduce relatively low or bass frequencies.

In the prior art of constructing loudspeaker systems designed for the reproduction of relatively low frequencies various systems have evolved broadly classifiable into large systems and small systems. In large systems the loudspeaker dimensions are comparable to at least a substantial fraction of the wavelength of sound in air of the lowest frequency to be reproduced satisfactorily. This group includes horn loaded and other large baffle designs.

The other group of small loudspeaker systems contains all those designs in which the loudspeaker system dimensions are a relatively small fraction of the lowest sound wavelength to be reproduced in air. This group includes the various direct radiator loudspeaker systems in which the loudspeaker acts as a vibrating piston mounted in an enclosure so that the sound radiated by both sides of that piston surface are effectively controlled. The front or outside surface radiates the desired acoustic waves directly while the rear or inside surface radiates sound into the enclosure, thereby preventing direct simultaneous radiation of sound of opposite phase which would tend to cancel acoustic output. It is recognized that numerous methods have been devised to utilize the radiation from the rear to enhance loudspeaker output at certain low frequencies.

Closed box or "infinite baffle" types of loudspeakers employing a moving coil dynamic loudspeaker driver when reproducing electrical signals may be characterized by the general equation:

$$W = Wo\left(\frac{-S^2}{1 + j\frac{S}{Q} - S^2}\right)^2$$

where W is the radiated sound power, Wo is the reference sound power related to equivalent input power and loudspeaker efficiency; S is frequency relative to the resonance frequency of the loudspeaker in the enclosure; and Q is the quality factor indicating the reciprocal of the damping factor of the loudspeaker. The equation may be recognized as that of a high-pass filter of the second order which would be maximally flat (no peak in response) if Q were equal to $1/\sqrt{2}$. Assuming that frictional losses can be neglected and assuming that the loudspeaker suspension stiffness is small compared to the stiffness of the air-spring formed by the volume of air contained in the enclosure, the following factor holds for a free-standing loudspeaker:

$$fc \simeq 128\left(\frac{Q\eta}{V}\right)^{\frac{1}{3}}$$

where fc is the resonant frequency between radiator mass and the enclosure volume V (measured in $m^3$), Q is the quality factor and $\eta$ is the relatively efficiency expressed as a fraction of acoustic output power to electrical input power, expressed as the square of input voltage divided by voice coil resistance.

Numerous attempts have been made to extend the low frequency range by an array of arrangements. For example, the use of a tuned vent or port permits the low frequency range to be extended with the overall response following the form of a fourth order filter. If such a filter were to be maximally flat, the low frequency -3 dB limit would be 0.841 times the -3 dB limit of a second order loudspeaker with the same moving mass and cabinet size. If the same efficiency were maintained along with the same cabinet size, the -3 dB limit would be 0.726 times the -3 dB limit of the second order loudspeaker.

The disadvantage of such an arrangement is the requirement of a substantially increased motor strength requiring larger magnets. Further disadvantages include the production of undesired rushing noises of relatively high velocity air passing through the vent opening and the existence of higher frequency resonances of the interior of the enclosure, causing substantial coloration or aberration of the frequency response of the loudspeaker.

In the present invention, the disadvantages of ported or vented loudspeakers have been overcome by use of a closed box loudspeaker system while the extended low frequency response has been obtained by the insertion of a passive electrical network in the loudspeaker connections to the output terminals of the driving amplifier. As an unexpected benefit of this invention certain critical relationships were discovered between loudspeaker and cabinet parameters on one hand and electrical network values on the other hand. Further relationships were discovered which permit the design of loudspeaker systems to follow the requirements of transfer functions of higher order than has been thought to be possible up to now.

BRIEF DESCRIPTION OF THE DRAWINGS

The invention will now be described with reference to the attached figures describing the invention in schematic representation. A preferred embodiment of the invention has been chosen for purposes of illustration and description and is shown in the accompanying drawings, forming a part of the specification, wherein:

FIG. 8 shows the general shape of the sound power output curve with respect to frequency.

FIG. 9 shows the general shape of the impedance curve of a prior art closed box loudspeaker.

FIG. 10 shows the general shape of the impedance curve of the loudspeaker system of the present invention.

FIGS. 12 and 13 illustrate the resultant frequency ratio, electrical losses, and component values as a function of mechanical loss to achieve a fourth order transfer function.

DESCRIPTION OF THE PREFERRED EMBODIMENT

Figure 1:
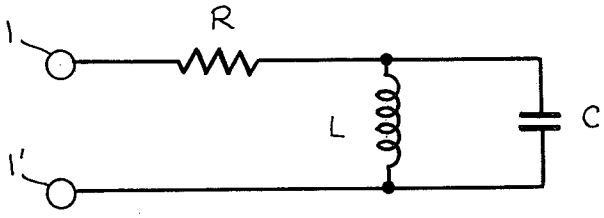
FIG. 1 shows the simplified electrical equivalent electrical network of the prior art closed box loudspeaker.

Referring to FIG. 1, the simplified equivalent electrical circuit of a closed box loudspeaker is shown in schematic representation. Resistor R is the voice coil resistance of a dynamic loudspeaker. Normally, some inductance would be connected in series with resistor R. Capacitor C represents the combined moving mass of the loudspeaker diaphragm and the mass of the air moved by the diaphragm as seen from the electrical terminals 1 and 1'. The actual masses move at the same velocity v and therefore produce an electromotive force or voltage e=Blv, where B is the magnet flux density of a permanent magnet system and l is the length of wire of the moving coil attached to that mass and subjected to a flux density B. The electrical current i, flowing through the coil, exerts a force f=Bli on that coil causing movement of the mass. Consequently, the mechanical moving parts of the loudspeaker may be thought of being connected to the electrical part by an ideal transformer having a turns ratio of Bl÷l, the transformer not having any limitations in frequency.

Thus, mass m becomes an equivalent electrical capacitor $C=m/(Bl)^2$ and a mechanical compliance Cm becomes an equivalent electrical inductor $L=Cm\times(Bl)^2$. Any mechanical damping becomes a resistor.

Acoustic output power from a closed box loudspeaker remains constant with respect to frequency when the diaphragm moves with constant acceleration and when the reproduced wavelength of sound in air is large compared to the dimensions of the acoustic radiator. Consequently, acoustic output power is proportional to the square of the current flowing in the equivalent capacitor C. This permits analysis of the low frequency response of the loudspeaker system by comparing the current flow through capacitor C to the input voltage impressed across terminals 1 and $\mathbf{1}_1$. The resulting ratio is the transfer admittance.

Examination of the circuit of FIG. 1 for transfer admittance shows that:

$$Y_{12}=\frac{1}{R}\ \frac{-w^2LC}{1+jw\frac{L}{R}-W^2LC}\ \text{where } w=2\pi f$$

which is of the form:

$$Y_{12}=\frac{1}{R}\ \frac{-S^2}{1+j\frac{S}{Q}-S^2}\ \text{where } S=\frac{W}{\sqrt{LC}}\ \text{and}$$

$$Q=\frac{1}{R}\sqrt{\frac{C}{L}}$$

This is the equation of a second order high-pass filter, which becomes maximally flat when $Q=1/\sqrt{2}$. Closed box loudspeakers with flattest response follow this equation. It is thus possible to analyze loudspeakers using electrical equivalent circuits.

In general, maximally flat filters follow the general form $|Y|^2=|1+X^{2n}|$ where n is the order of the filter, X is relative frequency or the inverse of frequency for a high-pass filter, and Y is the relative voltage ratio.

Heretofore, the design of loudspeakers having a transfer curve other than two has required the use of filters connected between the source of electrical signals and the amplifier which then fed a shaped signal to the loudspeaker. The reason was that the impedance variations of the loudspeaker were so large as to preclude the use of a loudspeaker as a suitable terminating impedance for a filter.

In the present invention it has been found possible to utilize the impedance variations of a loudspeaker as the actual network elements of a highpass filter of higher orders, while maintaining transfer curves to desired degrees of flatness of response.

Figure 2:
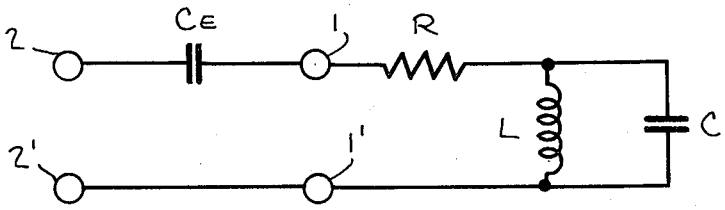
FIG. 2 shows the network connected to the closed box loudspeaker to effect a third-order transfer function.

In FIG. 2, a third-order network is shown using capacitor $C_E$ to couple the input signal from terminals 2 and $\mathbf{2}^1$ to the loudspeaker terminals 1 and $\mathbf{1}^1$. Maximally flat frequency response of the third-order results when coupling capacitor $C_E$ is adjusted to be three times as large as capacitor C, and the inductor L and capacitor C are tuned with a Q of $1/\sqrt{2}$ to a frequency higher by a factor of 1.061 than the half-power frequency of the system.

At first blush capacitor $C_E$ may seem to be nothing more than a coupling capacitor to the loudspeaker as has been used by designers of radio receivers and other devices. However, most of the coupling capacitors actually used were of the aluminum electrolytic variety which have a substantial internal series resistance as evidenced by the relatively high dissipation factor of more than 20% and furthermore have capacitance tolerances of typically more than 30%. Consequently, the critical nature of the capacitance value of three times the electrical equivalent capacitance of the loudspeaker causing a 6.1% extension in low frequency response would not have been apparent, since the equivalent series resistance of the capacitor $C_E$ might have dictated the use of a relatively large capacitor without having the benefit of extended low frequency response.

Figure 3:
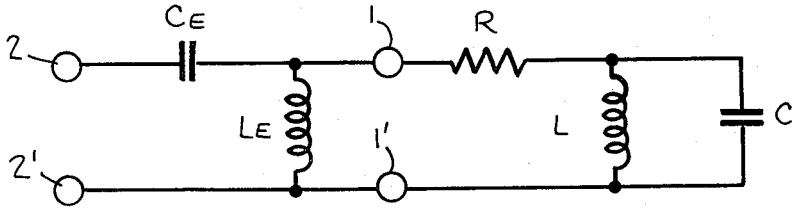
FIG. 3 shows a network connected to the closed box loudspeakers to effect a fourth-order transfer function.

In FIG. 3, inputs 1 and $\mathbf{1}^1$ of the loudspeaker are shown connected to a shunt inductor $L_E$ and then to a series capacitor $C_E$ to signal terminals 2 and $\mathbf{2}^1$. Maximally flat fourth-order response results when loudspeaker equivalent elements L and C are tuned to 1.758 times the desired half-power frequency having a Q of 0.890, while the combination of inductor $L_E$ and capacitor $C_E$ in equivalent parallel resonance with voice coil resistance R would be tuned to 0.569 times the half-power frequency having a Q of 0.890.

From a superficial investigation of such a circuit, one would suspect the frequency response of the high-pass filter of a loudspeaker crossover network. However, such networks have always been designed to have crossover frequencies above the resonance frequency of the driver, and not below that frequency, and were used to limit the frequency response of the driver rather than enhance low frequency output such as this critically designed network of FIG. 4.

Mathematically, the solution of the values of the transfer admittance of the third-order network comes from:

$$Y_{12} = \frac{1}{R} \times \frac{-jw\,RLC\,C_E}{1 + jwRC_E - W^2L\,(C + C_E) - jW^3RLC\,C_E}$$

Which is maximally flat when $Y_{12} = \frac{1}{R} \times \frac{-js^3}{1 + 2js - 2s^2 - js^3}$ Similarly, the solution of the values of the transfer admittance of the fourth-order network comes from:

$$Y_{12} = \frac{1}{R} \times \frac{W^4LC\,L_EC_E}{1 + jW\frac{(L_E + L)}{R} - W^2\,(L_EC_E + LC) - jW^3\frac{L_EL}{R}\,(C + C_E) + W^4LCL_EC_E}$$

which is maximally flat when:

$$Y_{12} = \frac{1}{R} \times \frac{-S^4}{1 + js\sqrt{2\,(\sqrt{2} + 2)} - S^2\,(\sqrt{2} + 2) - js^3\sqrt{2\,(\sqrt{2} + 2} + S^4}$$

Solution of these equations, using nodal analysis first showed that higher than second-order transfer admittance was possible contrary to expectations and that an extension of response could be the result, permitting the design of loudspeakers with closed, unvented enclosures of relatively small size. For the same low frequency limit and efficiency, a maximally flat third-order design described above requires only 84% of the cabinet volume of a second-order maximally flat design, while a maximally flat fourth-order design requires only 23% of the cabinet volume of the second-order design. This dramatic decrease is even more than experienced in designs employing vents, ports or other passive radiators.

Normally, that achievement of extended low-frequency response requires that the magnet system of the dynamic loudspeaker be enlarged. No enlargement is necessary when changing from a maximally flat second-order loudspeaker system to a maximally flat third-order system, since the loudspeaker Q requirements are identical. However, the change from a maximally flat second-order system to a maximally flat fourth-order system described above requires an increase in Q from 0.707 to 0.890, which results in a 26% decrease in magnet energy or magnet motor requirement measured as $(Bl)^2/R$. This is an unexpected benefit and was not anticipated.

In prior art loudspeaker systems equalization of frequency response has been successfully accomplished by employing an isolating amplifier with a built-in filter, the amplifier driving the loudspeaker system directly. Such equalizing filters were used to equalize the overall system response, with the filter at times responsive to the loudspeaker signal as disclosed in my pending application Ser. No. 035,496.

Figure 4:
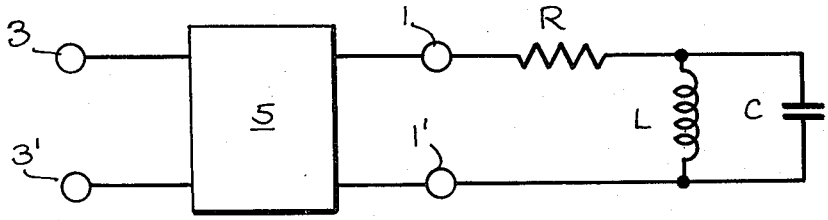
FIG. 4 shows an equalizer-amplifier connected to a closed box loudspeaker to effect a third or higher order transfer function such as used in prior art.

Schematically, a source of electrical signals is shown in FIG. 4 connected to the input terminals of equalizing amplifier 5, the output of which is connected to loudspeaker terminals 1 and $1^1$.

Similarly, the equalizing amplifier may be connected to the third-order or fourth-order loudspeaker systems described above to achieve transfer admittances higher by such order as the order of filter used in the amplifier signal circuits.

Figure 5:
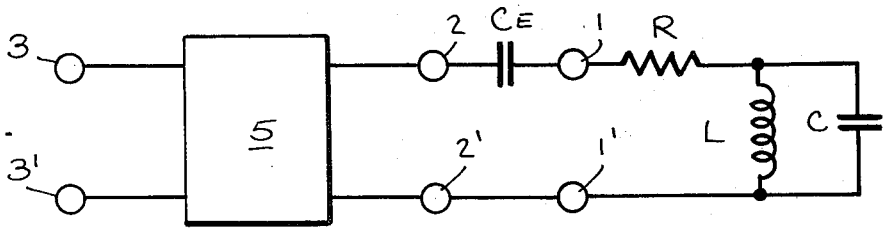
FIG. 5 shows an equalizer-amplifier connected to a third order closed box loudspeaker to effect a fourth or higher order transfer function.

FIG. 5 shows the source of signals connected to input terminals 3 and $3^1$ of equalizing amplifier 5, the output of which is connected to input terminals 2 and $2^1$ of the network Ce, the output of which feeds loudspeaker terminals 1 and $1^1$, thereby connecting a third-order loudspeaker system to the equalizing amplifier.

Figure 6:
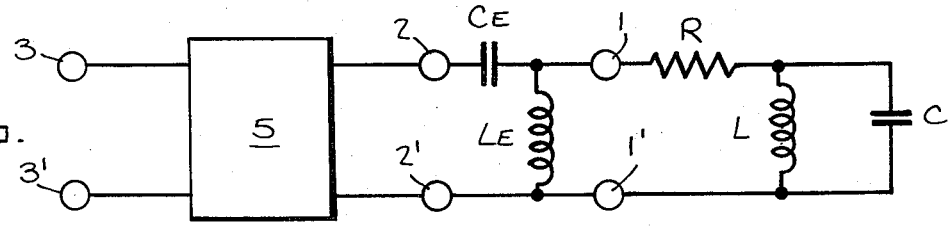
FIG. 6 shows an equalizer-amplifier connected to a fourth order closed box loudspeaker to effect a fifth or higher order transfer function.

FIG. 6 shows the same connections to a fourth-order loudspeaker system.

A maximally flat fifth-order transfer function is of the form:

$$Y_{12} = \frac{1}{R} \times \frac{js^5}{(1 + js)\,(1 + js\tfrac{1}{2}\,(\sqrt{5} + 1) - js^2)\,(1 + js\tfrac{1}{2}\,(\sqrt{5} - 1) - js^2)}$$

A maximally flat sixth-order transfer function is of the form:

$$Y_{12} = \frac{1}{R} \times \frac{-s^6}{\left(1 + js\sqrt{\sqrt{3} + 2} - s^2\right)\,(1 + js\sqrt{2} - s^2)\left(1 + js\frac{1}{\sqrt{\sqrt{3} + 2}} - s^2\right)}$$

Figure 7:
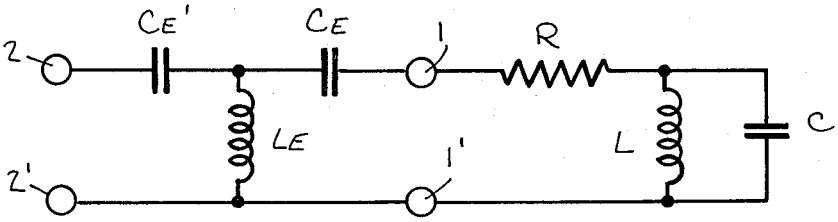
FIG. 7 shows a network connected to the closed box loudspeaker to effect a fifth order transfer function.

By appropriately choosing a single pole plus a pole pair defining a third-order loudspeaker and two pole pairs defining a fourth-order loudspeaker, the remaining pole or pole pair is then assigned to the amplifier equalization circuit. The solution of relative component values and resonance frequencies, Q factors is shown in Table 1, which also shows other pertinent data permitting the designer of loudspeaker systems to make suitable choices of values. The fifth-order equation could also be solved by use of a network as shown in FIG. 7. The values of capacitors $C_E$, $C_E^1$ and inductor $L_E$ can be found by the method outlined above. By an extension of the network having additional reactive components, loudspeaker systems of sixth- and higher order can be synthesized.

The solid line of FIG. 8 shows the relative sound power output with respect to frequency of the maximally flat loudspeaker systems disclosed above. If the design were made using solutions to elliptical equations, the dashed response curve would result. Since there is an infinitely large number of solutions to the transfer equations shown above, no numbers are shown here since they can be obtained by standard network analysis and synthesis.

FIG. 9 shows the magnitude of loudspeaker impedance measured with respect to frequency of loudspeaker impedance measured with respect to frequency of prior art closed box loudspeakers, such as shown in FIG. 1. The maximum occurs at the loudspeaker resonance and the minimum is equal to R.

FIG. 10 shows the magnitude of impedance of the third- and fourth-order loudspeaker systems measured at terminals 2 and $2^1$. The higher frequency maximum occurs at the resonant frequency formed by L and C while the minimum occurs below the half-power frequency as shown in Table 1. The value of the low frequency impedance minimum is shown in Table 1. The upper minimum impedance is equal to R.

Figure 11:
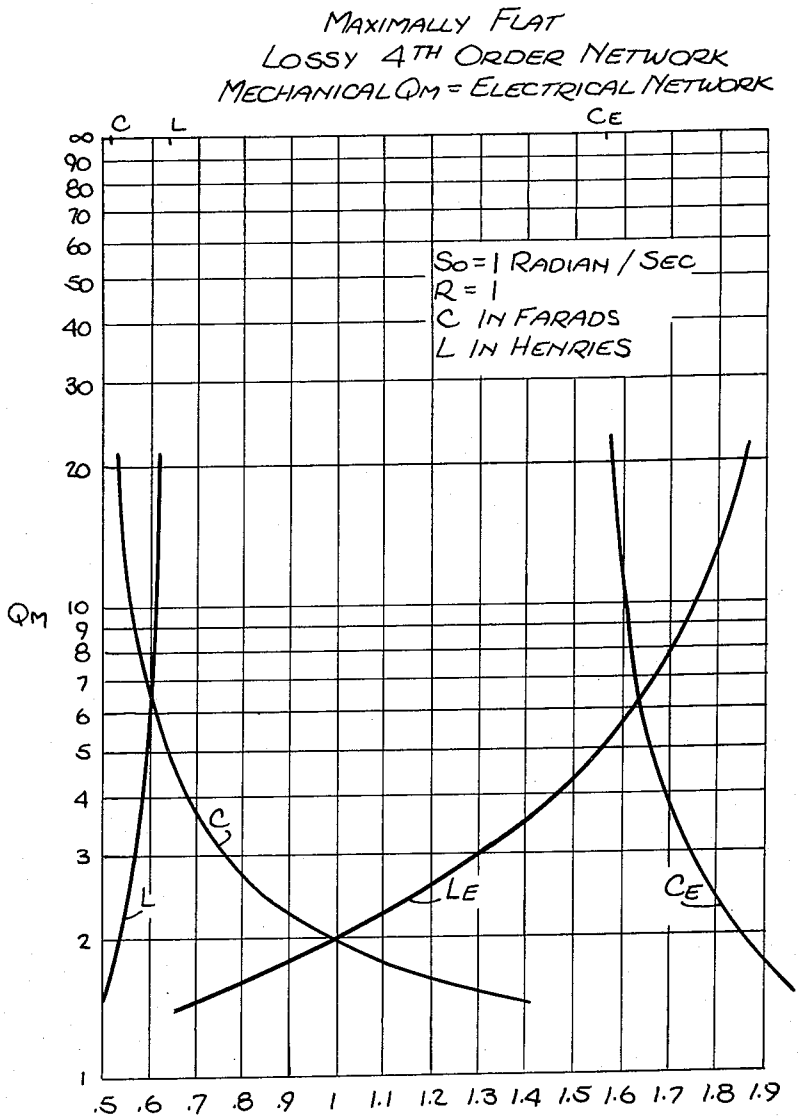
FIG. 11 shows a lossy network connected to a lossy closed box loudspeaker to effect a fourth order transfer function.
Figure 12:
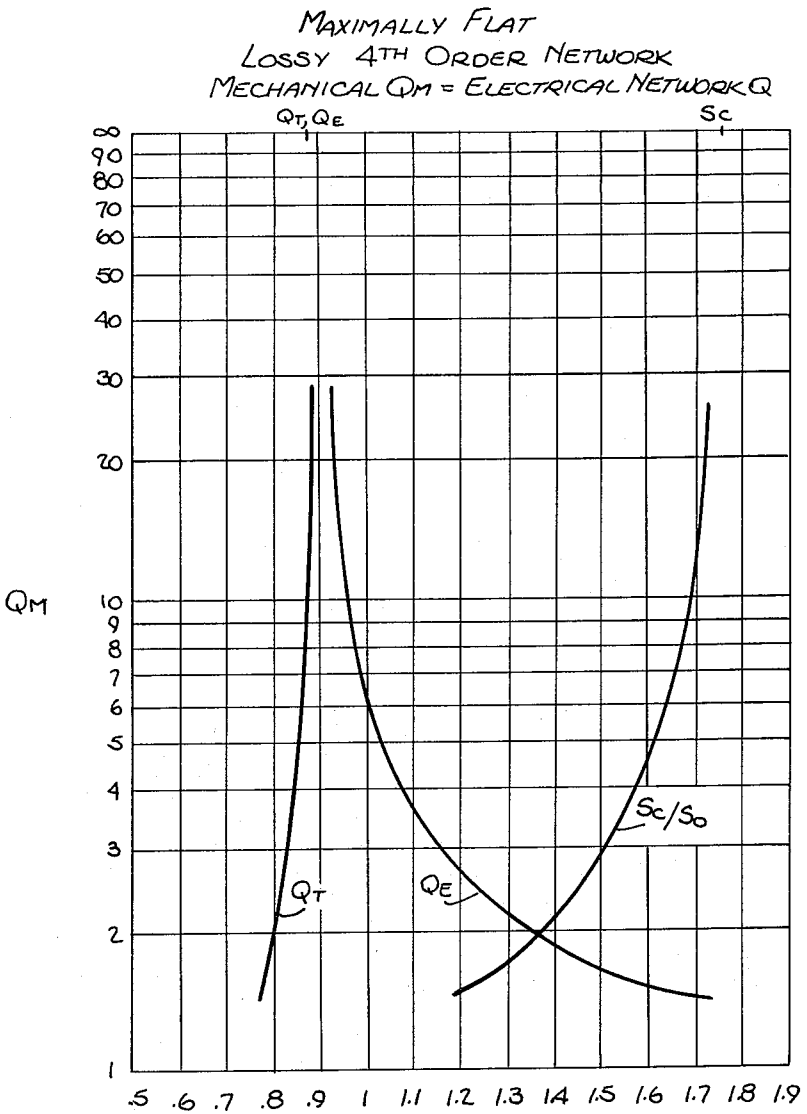

Assuming that the mechanical loss of a loudspeaker can be represented by a fixed resistor $R_M$ in FIG. 11 and that the electrical inductor and capacitor losses can be represented by a resistor $R_E$, an exact maximally flat fourth-order response can be achieved by choosing the relative frequency values and component values of FIGS. 12 and 13. Here the mechanical quality factor $$Q_M = \frac{1}{R_M}\sqrt{\frac{C}{L}},$$

the electrical quality factor $$Q_E = \frac{1}{R}\sqrt{\frac{C}{L}},$$

and the total quality factor $$Q_T = \frac{Q_M \cdot Q_E}{Q_M + Q_E}$$

are those typically used by loudspeaker designers.

Figure 14:
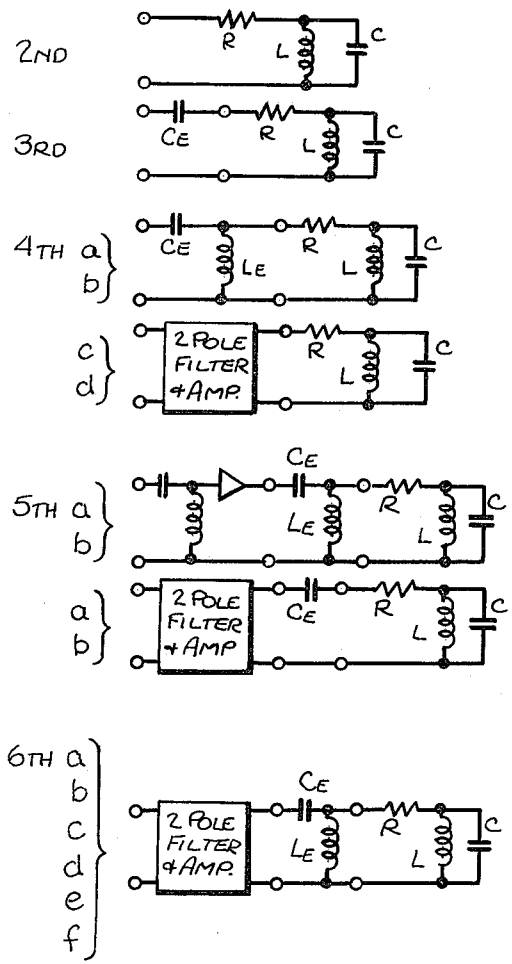
FIG. 14 is Table 1 illustrating component values for loudspeakers.

It should be noted that the values of Table 1 (FIG. 14) are those for lossless networks where $Q_M = \infty$ and $Q_T = Q_E$.

The solutions shown above of the maximally flat equations of the present invention have assumed, as a simplification, that all of the reactive components are lossless and ideal. It is recognized that loudspeakers have other frictional and electrical losses, while capacitors and inductors have additional resistive losses. The response values and the component values will be influenced by these losses, generally resulting in somewhat higher half-power frequencies and higher minimum impedances. Adjustment of component values can be made using normal engineering practice.

It should be also noted that the solution of the fourth-order equation results in two sets of component values in which values for L are exchanged for those of $L_E$ of first solution, as well as an interchange of the values for C and $C_E$. The result is a loudspeaker system of exact fourth-order maximally flat above the loudspeaker fundamental resonance. Such an increase is generally not valuable for a low frequency loudspeaker, but does have use for the crossover constants as applied to the high frequency drivers of a multi-driver loudspeaker system.

Although described with reference to loudspeaker systems the principles outlined in the present invention are applicable to other electrical, mechanical or acoustic systems where resonances occur.

The solutions to such systems are deemed to fall in the spirit and scope of this invention as delineated in the appended claims.

Having thus described my invention, I claim:

1. An improved loudspeaker system comprising the combination of:
   - a loudspeaker driver;
   - a closed box loudspeaker;
   - a passive electrical network for extending the loudspeaker response by performing a fourth-order transfer function;
   - means coupling said passive electrical network between said loudspeaker and the output of a loudspeaker driver;
   - said network comprising a shunt coupled inductance and a series coupled capacitor; and
   - a combination of said shunt coupled inductance and said series coupled capacitor in parallel resonance with the loudspeaker voice coil resistance being tuned to about 0.569 times the half power frequency of the driver with a Q of about 0.890.

2. An improved loudspeaker system comprising the combination of:
   - a closed box loudspeaker;
   - a passive electrical network for extending the loudspeaker response;
   - means coupling said passive electrical network between said loudspeaker and the output of a loudspeaker driver;
   - said network comprising a coupling capacitor having a capacity of about three times an equivalent capacity C representing the combined mass of the diaphragm of said loudspeaker and the mass of the moved air; and
   - said equivalent capacity C and an equivalent inductance L of the loudspeaker being tuned with a Q of $1/\sqrt{2}$ to a frequency higher by a factor of about 1.061 than the half power frequency of the driver where L equals $Cm \times (Bl)^2$ and Cm is the mechanical compliance and B is the flux density over a conductor of length l in the speaker voice coil.

3. The system as claimed in claim 2 which further comprises an equalizing amplifier coupled at the input of said coupling means.

* * * * *